US011725786B2

(12) United States Patent
Czech et al.

(10) Patent No.: US 11,725,786 B2
(45) Date of Patent: Aug. 15, 2023

(54) LIGHTING FIXTURE WITH ILLUMINATED END CAPS

(71) Applicant: Focal Point, LLC, Chicago, IL (US)

(72) Inventors: Ken Czech, Naperville, IL (US); Graeme Watt, Bowdon (GB); Casey Chung, Bloomingdale, IL (US); Ronaldo J. Santiago, South Elgin, IL (US); Paul O. Ocampo, Chicago, IL (US); Scott W. Beu, Bolingbrook, IL (US)

(73) Assignee: Focal Point, LLC, Chicago, IL (US)

( * ) Notice: Subject to any disclaimer, the term of this patent is extended or adjusted under 35 U.S.C. 154(b) by 0 days.

(21) Appl. No.: 17/462,565

(22) Filed: Aug. 31, 2021

(65) Prior Publication Data

US 2022/0090745 A1 Mar. 24, 2022

Related U.S. Application Data

(63) Continuation-in-part of application No. 29/704,945, filed on Sep. 9, 2019, now Pat. No. Des. 967,511, which is a continuation-in-part of application No. 29/681,654, filed on Feb. 27, 2019, now Pat. No. Des. 967,508.

(51) Int. Cl.

| | |
|---|---|
| ***F21S 4/28*** | (2016.01) |
| ***F21V 7/04*** | (2006.01) |
| *F21Y 115/10* | (2016.01) |

(52) U.S. Cl.

CPC ..... *F21S 4/28* (2016.01); *F21V 7/04* (2013.01); *F21Y 2115/10* (2016.08)

(58) Field of Classification Search

CPC ..... F21V 7/04; F21S 4/28

See application file for complete search history.

(56) References Cited

U.S. PATENT DOCUMENTS

| | | | | |
|---|---|---|---|---|
| 9,121,584 | B2 | 9/2015 | Santoro et al. | |
| 9,982,872 | B1 * | 5/2018 | Kearney | F21V 29/508 |
| 2022/0205602 | A1 * | 6/2022 | Chen | H05B 45/3725 |

FOREIGN PATENT DOCUMENTS

| | | | | |
|---|---|---|---|---|
| CA | 2434689 | C * | 9/2010 | F21S 4/28 |
| EP | 3748223 | A1 * | 12/2020 | |

OTHER PUBLICATIONS

Quintetta Linear Glow, amerlux, Passion. Power. Performance., LIT-2064, Dec. 22, 2016, 7 pgs.

* cited by examiner

*Primary Examiner* — Anabel Ton

(74) *Attorney, Agent, or Firm* — Greenberg Traurig, LLP

(57) ABSTRACT

A lighting fixture includes a housing with a first end and a second end. The lighting fixture further includes a first plurality of light emitting diodes (LEDs) configured to illuminate a main lens of the housing between the first end and the second end. The lighting fixture further includes an end cap disposed at the first end. The end cap includes an end cap lens and a second plurality of LEDs configured to illuminate the end cap lens independently from the first plurality of LEDs. The end cap further includes a wall configured to substantially prevent light emitted from the second plurality of LEDs from being emitted through the main lens of the housing.

19 Claims, 14 Drawing Sheets

FIG. 5G
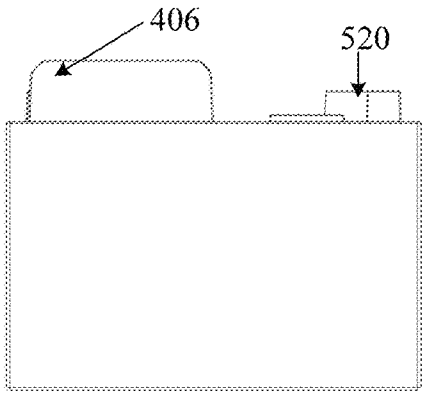
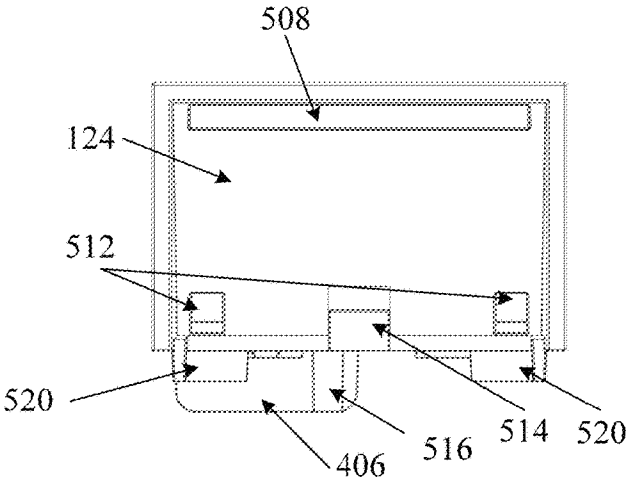
FIG. 5H
FIG. 5F
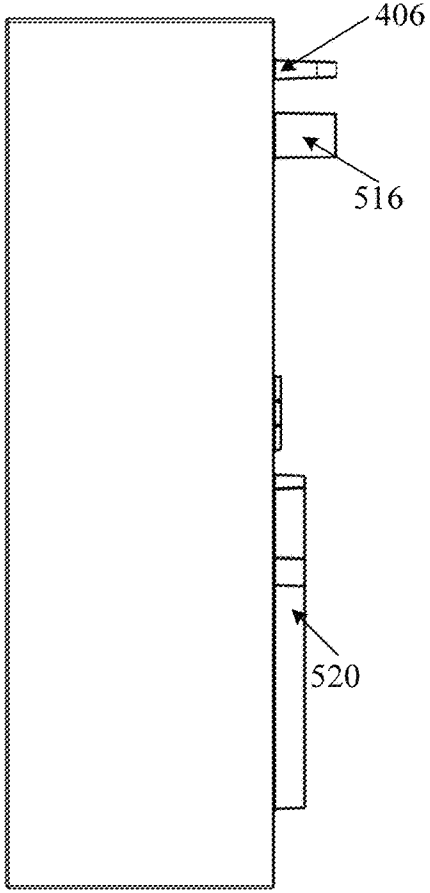
FIG. 5E
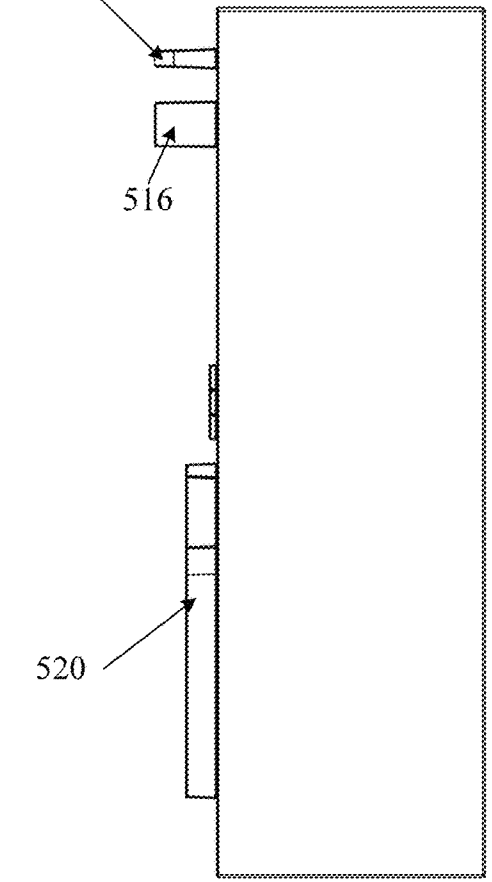

LIGHTING FIXTURE WITH ILLUMINATED END CAPS

CROSS REFERENCE TO RELATED APPLICATIONS

This application claims priority to and is a continuation-in-part of U.S. Design patent Application No. 29/704,945, filed on Sep. 9, 2019, which claims priority to and is a continuation-in-part of U.S. Design patent application No. 29/681,654, filed on Feb. 27, 2019, each of which are hereby expressly incorporated by reference in their entirety.

FIELD OF THE DISCLOSURE

This disclosure relates to systems and apparatuses for a lighting fixture having an illuminated end or end cap.

BACKGROUND

Linear architectural lighting includes systems or fixtures that are elongated and include a main luminous surface intended to light an indoor area. These fixtures may be attached to a ceiling within an indoor space, such that the main luminous surface primarily directs light toward the floor of the indoor space.

SUMMARY

An example embodiment of a lighting fixture includes a housing with a first end and a second end. The lighting fixture further includes a first plurality of light emitting diodes (LEDs) configured to illuminate a main lens of the housing between the first end and the second end. The lighting fixture further includes an end cap disposed at the first end, at a second end, or at both ends. The end cap includes an end cap lens and a second plurality of LEDs configured to illuminate the end cap lens. The end cap further includes a wall configured to substantially prevent light emitted from the second plurality of LEDs from being emitted through the main lens of the housing.

An example apparatus includes a housing with a first end and a second end. The apparatus further includes a first light source configured to illuminate a main lens of the housing between the first end and the second end. The apparatus further includes an end cap lens at one or both ends and a second light source configured to illuminate the one or more end cap lenses. The apparatus further includes a wall within the housing configured to substantially prevent light emitted from the second light source from being emitted through the main lens. The apparatus further includes at least one control circuit configurable to provide at least one control signal for controlling the first light source and the second light source.

One example of the present invention addresses a lighting fixture that includes a housing and a wall within the housing, in which the wall and the housing together form a first optical chamber and a second optical chamber separated by the wall. The lighting fixture further includes a first light source in the first optical chamber configured to illuminate a first lens attached to the housing. The lighting fixture further includes a second light source in the second optical chamber configured to illuminate a second lens attached to the housing, in which the first lens is oriented generally orthogonally to the second lens.

BRIEF DESCRIPTION OF THE DRAWINGS

FIG. 5E is a left side elevational view of the end cap of FIG. 5A, according to some aspects of the present disclosure.

FIG. 5F is a right side elevational view of the end cap of FIG. 5A, according to some aspects of the present disclosure.

FIG. 5G is a top plan view of the end cap of FIG. 5A, according to some aspects of the present disclosure.

FIG. 5H is a bottom plan view of the end cap of FIG. 5A, according to some aspects of the present disclosure.

DETAILED DESCRIPTION

Figure 1A:
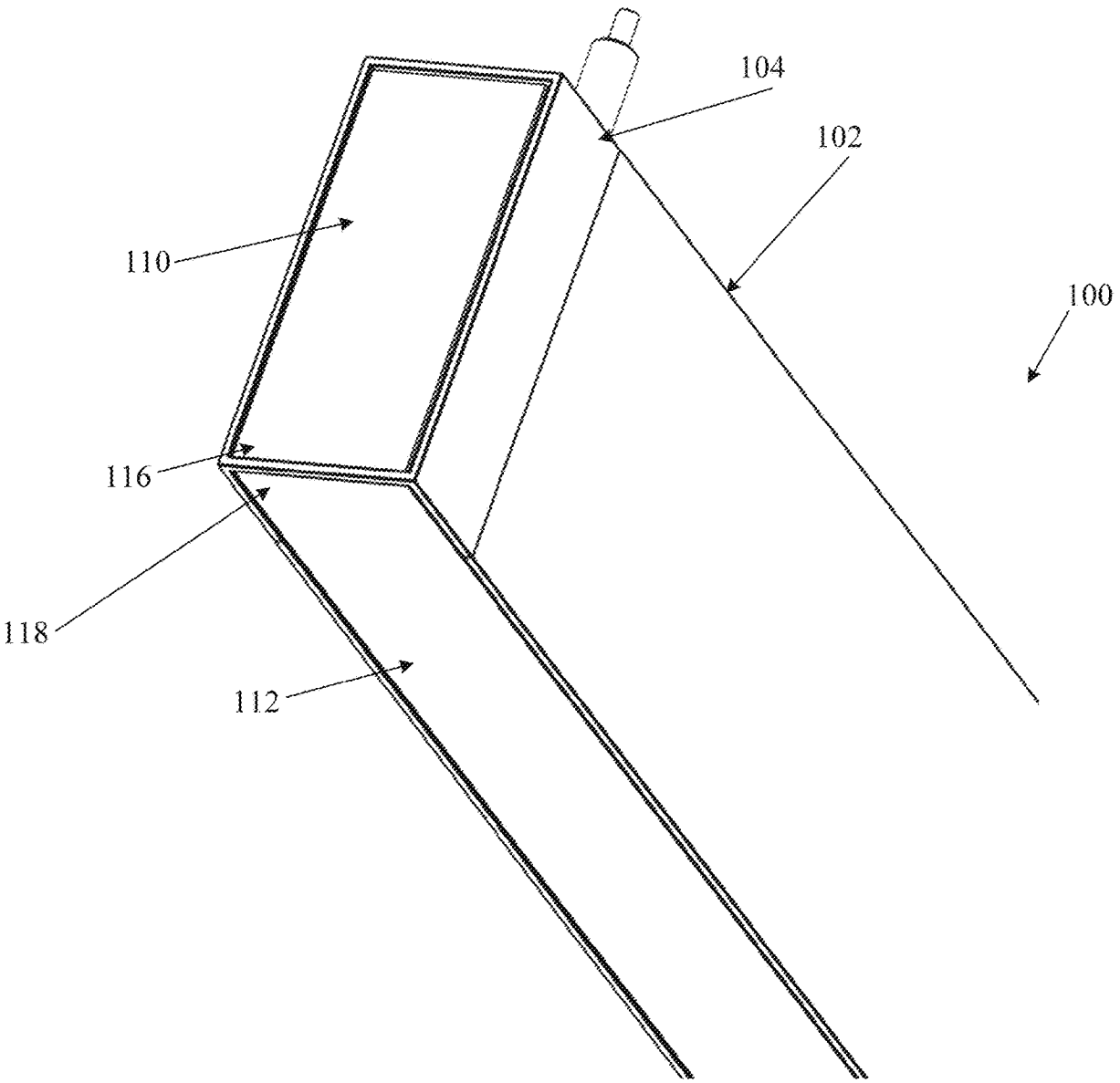
FIG. 1A is a bottom-left perspective view of a portion of a lighting fixture with an illuminated end cap, according to some aspects of the present disclosure.

Described herein are apparatuses and systems that utilize a modular or integral illuminated end or end cap element to illuminate an end or end cap of a lighting fixture. The light sources (e.g., light emitting diodes (LEDs)) used to emit light for the end or end cap of the light fixture may have a dedicated light engine and/or control circuitry, or may be controlled using the same light engine and/or control circuitry used to control the light source of the main body of a light fixture (e.g., a light source that illuminates a portion of a light fixture other than the end or end cap). The end or end cap of the light fixture may further have a dedicated optical chamber that is segregated from other one or more other optical chambers in the fixture (e.g., an optical chamber associated with a light source that illuminates a portion of the light fixture other than the end or end cap).

In various embodiments of the invention, a linear lighting fixture may be modified such that circuitry of the lighting fixture provides power to a light source at or in the end or in the end cap of the fixture. Circuiting design may therefore use power from a main power input of a linear light fixture to power a light source in an end or end cap of the fixture. The light source in the end or in the end cap may further be controlled such that any of an illuminance level, color temperature, brightness, or any other desired light quality of the light source in the end or end cap of the fixture may generally match the lighting characteristics of the light emitted by a main source of light (e.g., the light source of a linear fixture that illuminates a floor of an interior space). In this way, the light emitted at the end or from a generally vertically oriented end surface or face of a fixture, may generally match the light emitted from one or more other generally horizontal surfaces or faces of the fixture.

Various embodiments described herein therefore provide light output at different angles (e.g., toward a floor, toward a wall, into a corner, etc.) by positioning a separate light sources or engines in different dedicated optical chambers in distinct planes of orientation. The different, segregated optical chambers help prevent the light sources or engines in the different chambers from impacting light emitted in different directions from different surfaces of the fixture. For example, two light sources in respective segregated optical chambers may be configured to output light from the bottom of a fixture generally toward the floor of an interior space and from an end of the fixture generally toward a wall, respectively. In other words, light may be output outwardly from an end cap lens of a fixture to provide light in an additional direction, while also providing generally uniform light that matches the light output emitted through the main lens of a fixture.

In various embodiments, light may be output from an end of a linear fixture with a segregated optical chamber that is integrally formed into the fixture. In various other embodiments, an end cap may be added to a linear fixture to add the additional functionality of light emitted from an end of a fixture, where the addition of an end cap adds an additional optical chamber segregated from a main optical chamber of a fixture. Such a modular approach may significantly reduce the costs associated with manufacturing light fixtures, as fewer unique fixture components may be manufactured, and a given fixture may be readily modified to have an end cap or not.

Segregation of optical chambers may yield other benefits. For example, various light fixture embodiments described herein may include separate lenses associated with the segregated optical chambers of a light fixture, such that light from a main optical chamber is emitted through a main lens and light from a secondary optical chamber associated with an end of a fixtured is emitted through an end cap lens. Having two separate lenses may reduce costs in manufacturing the fixture, as the two lenses may be relatively simple and likewise easier to manufacture. For example, each of the lenses may be straight and have a flat surface from which light is emitted. Compared to forming a single curved lens that wraps around an end of a fixture, the two flat lenses may be less costly and less difficult to assemble, with higher light-emitting precision than complicated lens designs such as curved lenses. In addition, the multiple separate lenses may better accommodate the separate optical chambers described herein by reducing light leakage between the chambers, because the chambers do not share a single lens. This modular approach (e.g., independently chambered/controlled sets of light sources) may therefore provide a matched illuminance between direct and end faces of a fixture while also providing uniformity in illuminance across an end plane associated with the end cap or end of the fixture. In various embodiments, a fixture may also have two or more illuminated ends as described herein.

Figure 1B:
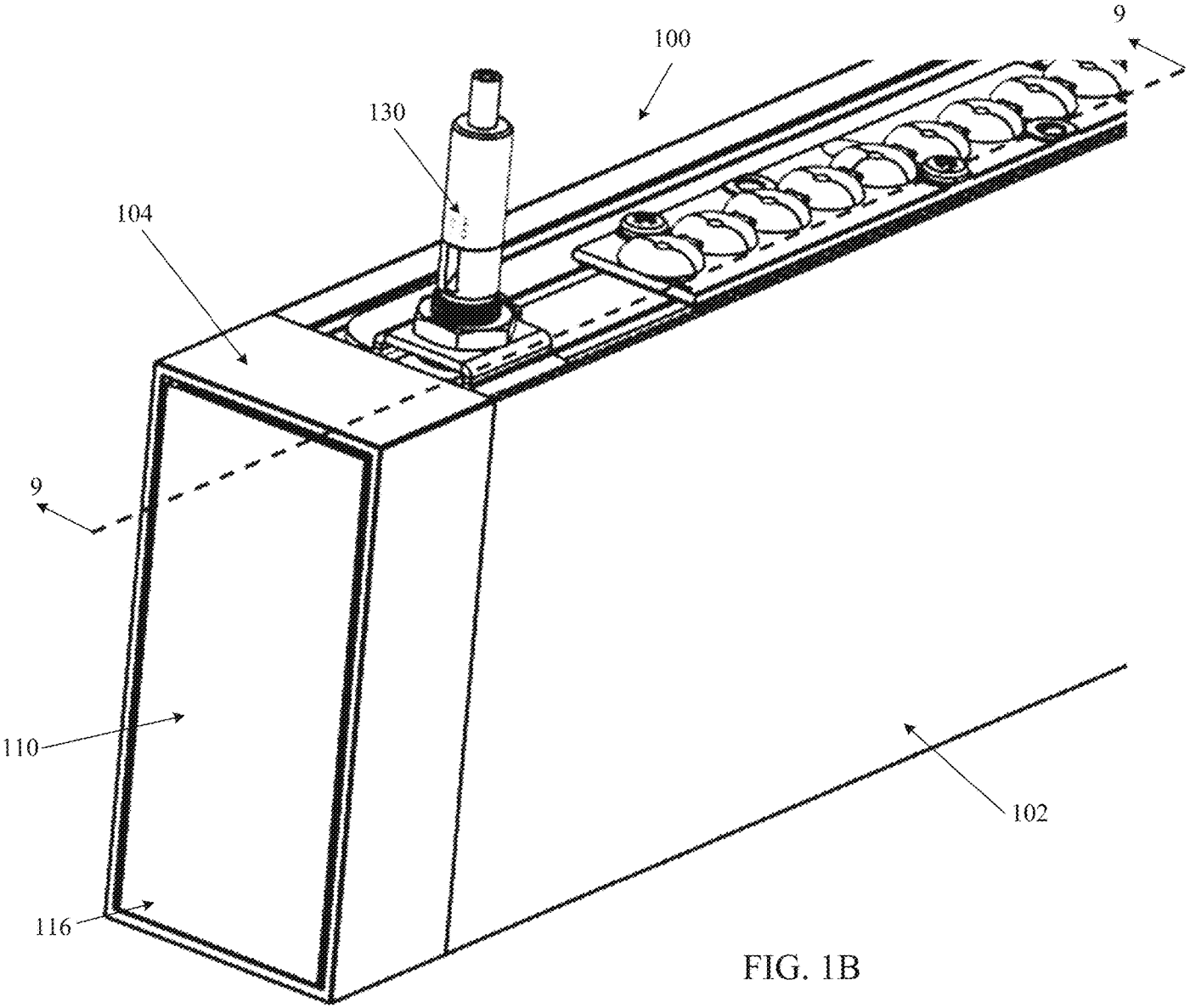
FIG. 1B is a top-left perspective view of a portion of a lighting fixture with an illuminated end cap, according to some aspects of the present disclosure.
Figure 1C:
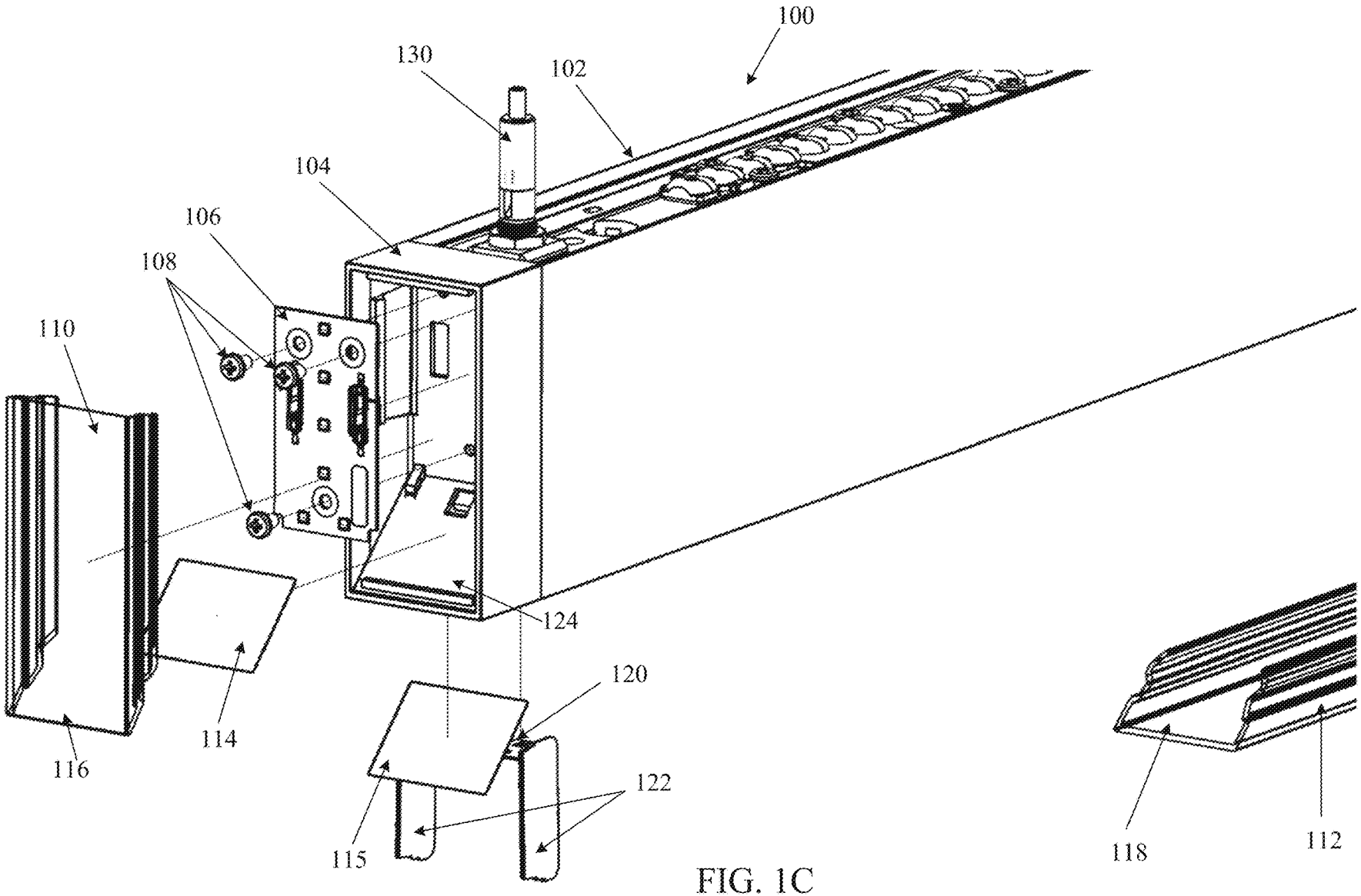
FIG. 1C is an exploded top-left perspective view of a portion of a lighting fixture with an illuminated end cap, according to some aspects of the present disclosure.

Looking at the drawings, FIG. 1A is a bottom-left perspective view of a portion of a lighting fixture 100 with an illuminated end cap, according to some aspects of the present disclosure. FIG. 1B is a top-left perspective view of a portion of lighting fixture 100 with an illuminated end cap. FIG. 1C is an exploded top-left perspective view of a portion of lighting fixture 100 with an illuminated end cap. Lighting fixture 100 includes a main housing 102, an end cap 104, an end cap lens 110, and a main lens 112. Main lens 112 (e.g., a first lens) is oriented on a bottom face of fixture 100 (e.g., as shown in FIG. 1A), so as to transmit light downwardly, toward the floor of an interior space, for example. Main lens 112 may have a feature that inserts into and connects to housing 102 in an opening on the bottom of main housing 102 (not shown in FIGS. 1A through 1C).

In FIGS. 1A through 1C, end cap 104 is a separate component that is attached to housing 102. In various embodiments, end cap 104 may be integrally formed with housing 102 such that end cap 104 is an integral part of housing 102. Housing 102 may include some or all of the features and or subcomponents of end cap 104 as described herein. As such, a lighting fixture may have all the features of end cap 104 without end cap 104 being a separate component from housing 102.

End cap lens 110 (e.g., a second lens) is located on a first end or left side of fixture 100, such that the surface of end cap lens 110 visible in FIGS. 1A and 1B faces in a direction orthogonal to that of main lens 112. In this way, main lens 112 may generally transmit light toward the ground of an interior space, for example, while end cap lens 110 may generally transmit light toward a wall or corner of two walls in an interior space. Such a configuration may help light space in an interior space that is not generally under fixture 100, as linear fixtures often do not extend all the way to walls within an interior space. As such, a greater uniformity of illumination may be achieved in a room or interior space as described herein.

End cap 104 includes multiple subcomponents and is connected to main housing 102. Further details of end cap 104 are shown in and described with respect to FIGS. 5A through 5H. For example, end cap 104 may include an end cap light emitting diode (LED) board 106, fasteners 108, end cap lens 110, and end cap reflectors such as end cap reflector 114. LED board 106 may be, for example, a printed circuit board (PCB) with circuitry printed thereon and light sources (e.g., light emitting diodes) mounted thereon. LED board 106 may be attached to end cap 104 using fasteners 108. Fasteners 108 may be screws, though in various embodiments LED board 106 may be fastened to end cap 104 in other ways. One or more of fasteners 108 may also pass through a mounting surface of end cap 104 to connect LED board 106 and end cap 104 to main housing 102, as described below and shown with respect to FIGS. 8 and 9. Main housing 102 may include hardware 130 for attaching lighting fixture 100 to a surface such as a ceiling of an interior space. For example, hardware 130 may be configured for a hanging mount, such as by a rope, bolt, or chain from a ceiling or elevated surface. In various embodiments, other mountings may be used with the light fixtures described herein, such as wall mounts.

Lighting fixture 100 may include multiple sets of LEDs mounted to one or more LED boards. Further details of the LEDs in lighting fixture 100 are shown in and described with respect to FIGS. 6A, 6B, 7, and 9. In one example, main housing 102 includes a first set of LEDs (e.g., LEDs 702 of FIG. 7) mounted to a first LED board and end cap 104 includes a second set of LEDs (e.g., LEDs 218 of FIGS. 2 and 6A) mounted to LED board 106. While described at a first end of main housing 102, main housing 102 may include an additional end cap that is similar to end cap 104 at each of two ends of main housing with respective sets of LEDs and LED boards (e.g., first and second end caps 306 and 308 of FIG. 3). In various embodiments, lighting fixture 100 may have a single light driver or control circuit that is electrically connected to the first set of LEDs and the sets of LEDs that correspond to each end cap.

In other configurations, the lighting fixture 100 may have multiple light driver or control circuit configurations as desired for a particular application of lighting fixture. Additional configurations may include any of: (1) a light driver or control circuit that control sets of LEDs corresponding sets of LEDs in one or more end caps and a separate light driver or control circuit for the a set of LEDs in a main housing; or (2) a light driver control circuit for a set of LEDs in a main housing, a second light driver or control circuit for a set of LEDs in a first end cap, and a third light driver or control circuit for a set of LEDs in a second end cap. In various embodiments, regardless how many light drivers and/or control circuits are used, the various sets of LEDs in a fixture may be powered by a common power input to the fixture and may be controlled by a common switch that controls power delivery to the fixture. Similarly, while different sets of LEDs may have different drivers or control circuits, the drivers and/or control circuits may each be connected to a common controller or processor, which may receive signals for controlling the different sets of LEDs via the different drivers and/or control circuits. Lighting drivers and control circuits as described herein may include conventional circuitry components as is known in the art.

In various embodiments, end cap 104 may be a metal such as cast aluminum and mounted to main housing 102 by welding, mechanical grooves, and/or fasteners. End cap 104 may be configured to receive LED board 106 and end cap lens 110 thereon, such that each of LED board 106 and end cap lens 110 are affixed thereto. End cap 104 may have one or more lens engagement features 202 (obscured in FIG. 1C, but shown in FIGS. 2, 5A, and 5C) that engages a portion of end cap lens 110 to fasten end cap lens 110 to end cap 104. Corresponding engagement features of end cap 104 attach to engagement features 202 of end cap lens 110. In various embodiments, end cap 104 may be flush mounted to main housing 102 such that a tapered edge 116 of end cap lens 110 fastened to end cap 104 is adjacent to a tapered edge 118 of main lens 112 (though tapered edge 116 of end cap lens 110 is on an opposite side of a wall 124 of end cap 104 from tapered edge 118 of main lens 112). In such examples, lighting fixture 100 may provide generally continuous and uniform light toward a bottom and side of lighting fixture 100 using first set of LEDs 702 mounted to main housing 102 and second set of LEDs 218 mounted to end cap LED board 106. In addition, as shown in FIG. 1A, tapered edge 116 of end cap lens 110 and tapered edge 118 of main lens 112 extend almost to the corners of lighting fixture 100, separated only by a thin corner of end cap 104 that also makes up a corner of lighting fixture 100.

In various embodiments, end cap lens 110 and/or main lens 112 may be shaped differently to extend beyond end cap 104 and/or main housing 102, respectively. End cap lens 110 and/or main lens 112 may be configured so as to not be generally flush with the edges of a housing of a lighting fixture. Similarly, end cap lens 110 and/or main lens 112 may be shaped to be recessed within end cap 104 and/or main housing 102, respectively. In so doing, end cap lens 110 and/or main lens 112 may also be configured so as to not be generally flush with edges of a housing of a lighting fixture. As such, an edge of end cap lens 110 and/or main lens 112 may not be joined at a generally flush corner position as shown in FIG. 1A, but may be shaped, as desired, to provide different lighting configurations.

Figures 6A, 6B:
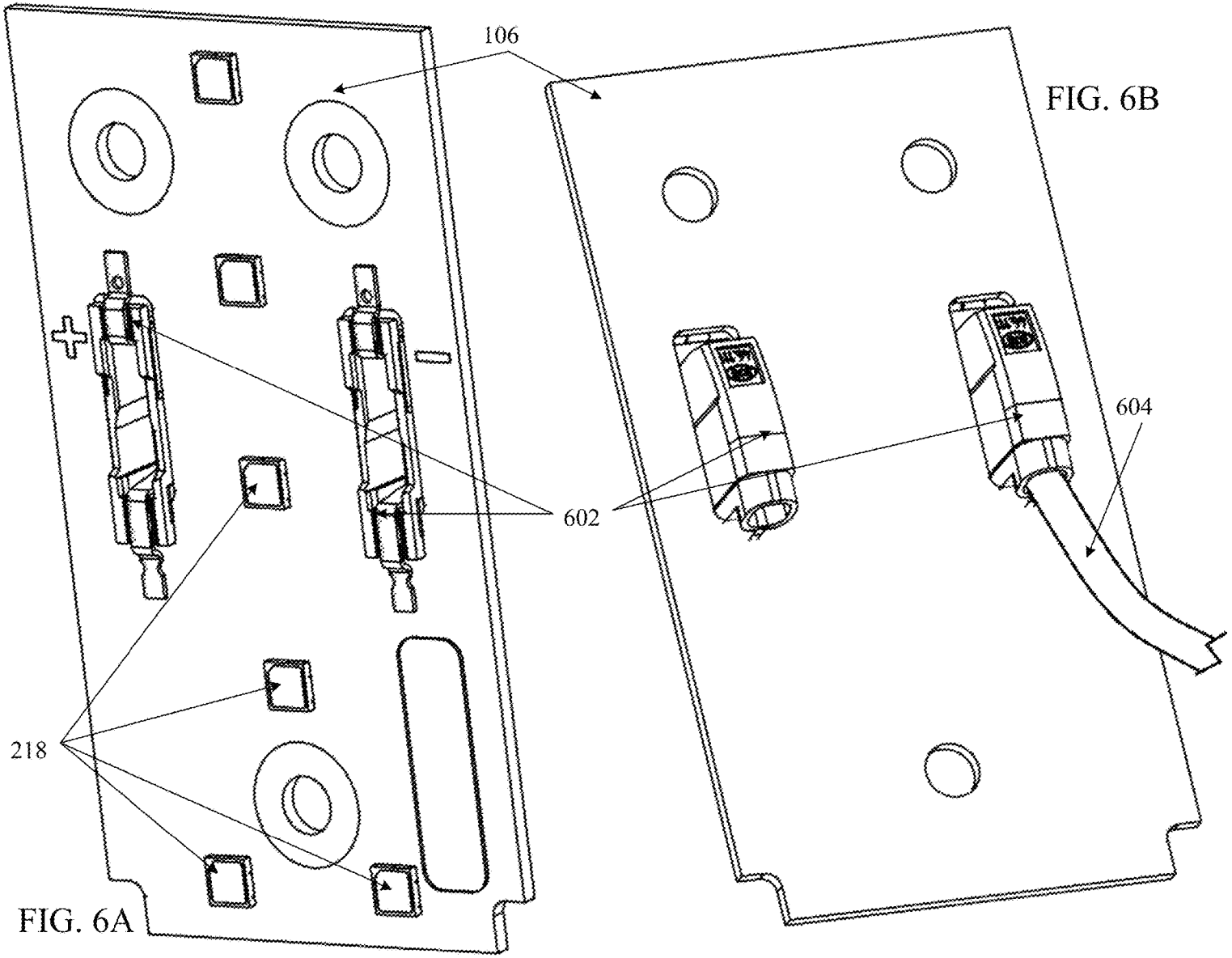
FIGS. 6A and 6B show front and rear perspective views, respectively, of a light emitting diode (LED) board, according to some aspects of the present disclosure.

LED board 106 may be a printed circuit board (PCB) or other suitable substrate for a light engine or otherwise, for mounting one or more LEDs (e.g., LEDs 218 of FIG. 6A). LED board 106 may include electrical connections and/or circuitry for connecting to a light driver or control circuit. In various embodiments, LED board 106 may be connected to a driver or control circuit that is shared with one or more other sets of LEDs in lighting fixture 100 as described herein.

Figure 9:
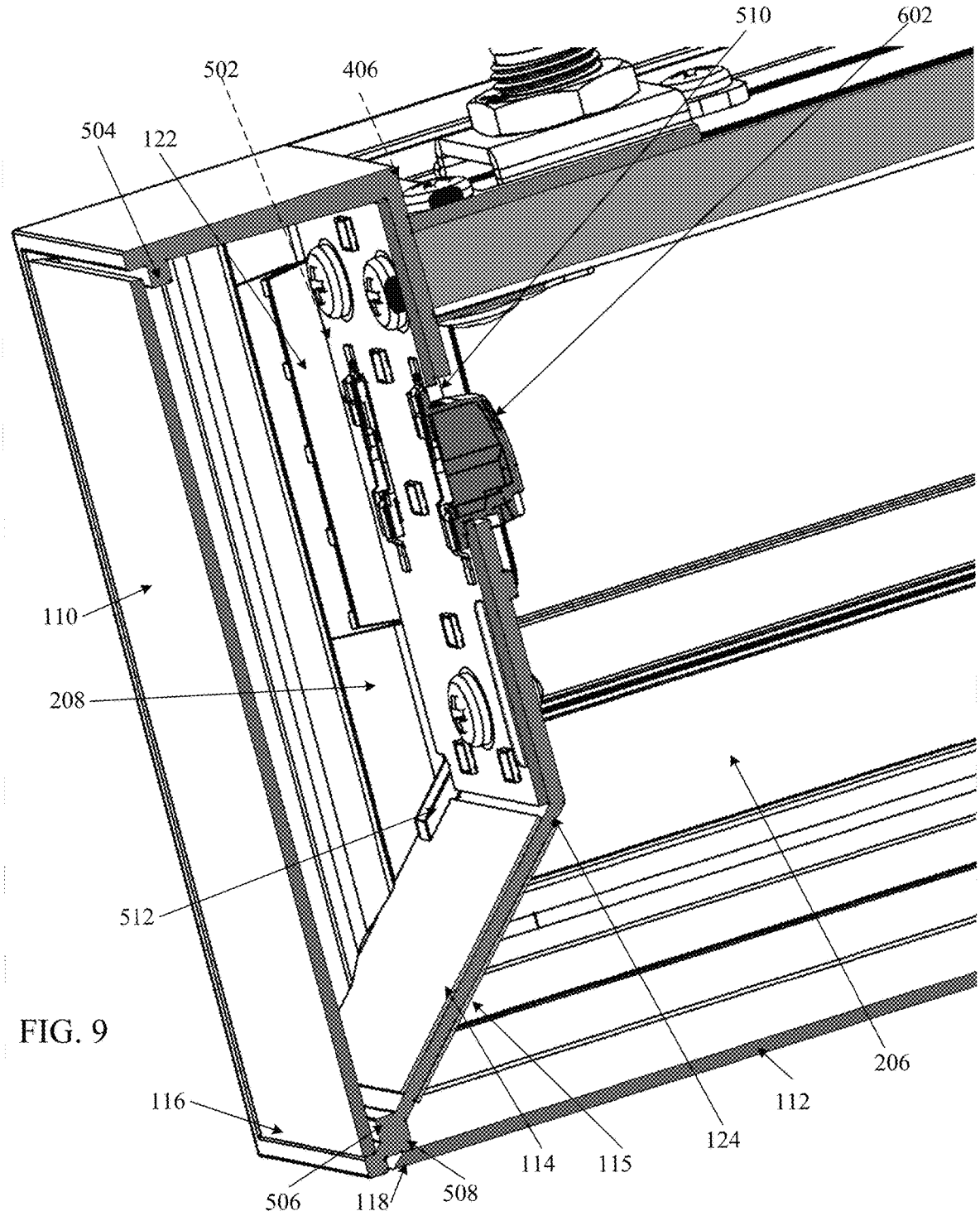
FIG. 9 shows a cross-sectional perspective view of an end cap of a lighting fixture, taken along line 9-9 of FIG. 1B, and looking in the direction of the arrows, according to some aspects of the present disclosure.

End cap lens 110, as shown in FIGS. 1A through 1C, may be made of any material that permits the transmission of light generated by a light source such as LEDs 218. End cap lens 110 may be configured to focus or disperse light emitted by a light source, for example by means of refraction. For example, referring to FIG. 9 showing a cross-section of end cap 104, end cap lens 110 may be configured to focus or disperse light differently that received at a lower portion of end cap lens 110 that corresponds to tapered edge 116 and/or is closer to an end cap reflector 114 as compared to a higher portion of end cap lens 110 that is closer to LED board 106 and/or LEDs 218. In this way, end cap lens 110 may be configured to receive unevenly emitted light from LEDs 218 and transmit the light in a more uniform pattern. In various embodiments, other refractive patterns may be used for end cap lens 110, including a uniformly configured end cap lens. End cap lens 110 may be one or more portions or layers of transmissive material. End cap lens 110 may be made of materials such as glass, polymer, plastic, or the like, in various embodiments.

As shown in FIGS. 1C, 4A, 4B, and 9, end cap reflector 114 and a main housing reflector 115 may be reflective to enhance how light generated/emitted by first set of LEDs 702 attached to main housing 102 and second set of LEDs 218 is provided to main lens 112 and end cap lens 110, respectively. End cap reflector 114 and main housing reflector 115 may each be attached to opposing sides of wall 124 of end cap 104. As such, light emitted by second set of LEDs 218 that moves toward the bottom of lighting fixture 100 (e.g., toward main lens 112) may be reflected and redirected toward end cap lens 110, by end cap reflector 114. As shown in greater detail in FIG. 9, end cap reflector 114 may extend toward tapered edge 116 of end cap lens 110. In this way, light emitted by LEDs 218 may be more evenly directed toward end cap lens 110 due to end cap reflector 114 being attached to wall 124, in a position that generally corresponds with tapered edge 116 of end cap lens 110.

Similarly, light emitted by first set of LEDs 702 that is directed toward an end of lighting fixture 100 (e.g., toward end cap lens 110) may be reflected and redirected toward main lens 110 by main housing reflector 115. As shown in greater detail in FIG. 9, main housing reflector 115 may extend toward tapered edge 118 of main lens 112. In this way, light emitted by LEDs 702 may be more evenly directed toward main lens 112 due to main housing reflector 115 being attached to wall 124 in a position that generally corresponds with tapered edge 118 of main lens 112. Accordingly, wall 124 serves to substantially block or prevent light emitted by LEDs 218 in end cap 104 from reaching and/or being transmitted by main lens 112. Similarly, wall 124 serves to substantially block or prevent light emitted by LEDs 702 in main housing 102 from reaching or being transmitted by end cap lens 110.

In various embodiments, end cap reflector 114 and/or main housing reflector 115 may be configured to block or absorb one or more selected frequency bands in the visible spectrum of light, while reflecting one or more other frequency bands of visible light. End cap reflector 114 and/or main housing reflector 115 may be mounted to wall 124 by adhering end cap reflector 114 and/or main housing reflector 115 to an intermediate substrate that is attached to wall 124, or may itself be attached directly to wall 124, etc. In various embodiments, end cap reflector 114 and/or main housing reflector 115 may together be formed as a two-sided reflector, as part of wall 124, rather than comprising separate components, be integrated with a first side of wall 124 configured to reflect light from first plurality of LEDs 702 through main lens 112, and a second side of wall 124 configured to reflect light from second plurality of LEDs 218 through the end cap lens. In various embodiments, one or both of end cap reflector 114 and/or main housing reflector 115 may also comprise coatings that are applied to wall 124, rather than rigid plates for reflecting, as shown in FIG. 1C. In various embodiments, wall 124 may also be formed of a reflective material and/or treated or conditioned (e.g., polished) to be reflective instead of, or in addition to, having end cap reflector 114 and/or main housing reflector 115 mounted thereon. Similarly, any of the surfaces in end cap 104 may be coated to be reflective, or be formed or treated/conditioned to be reflective.

Figure 2:
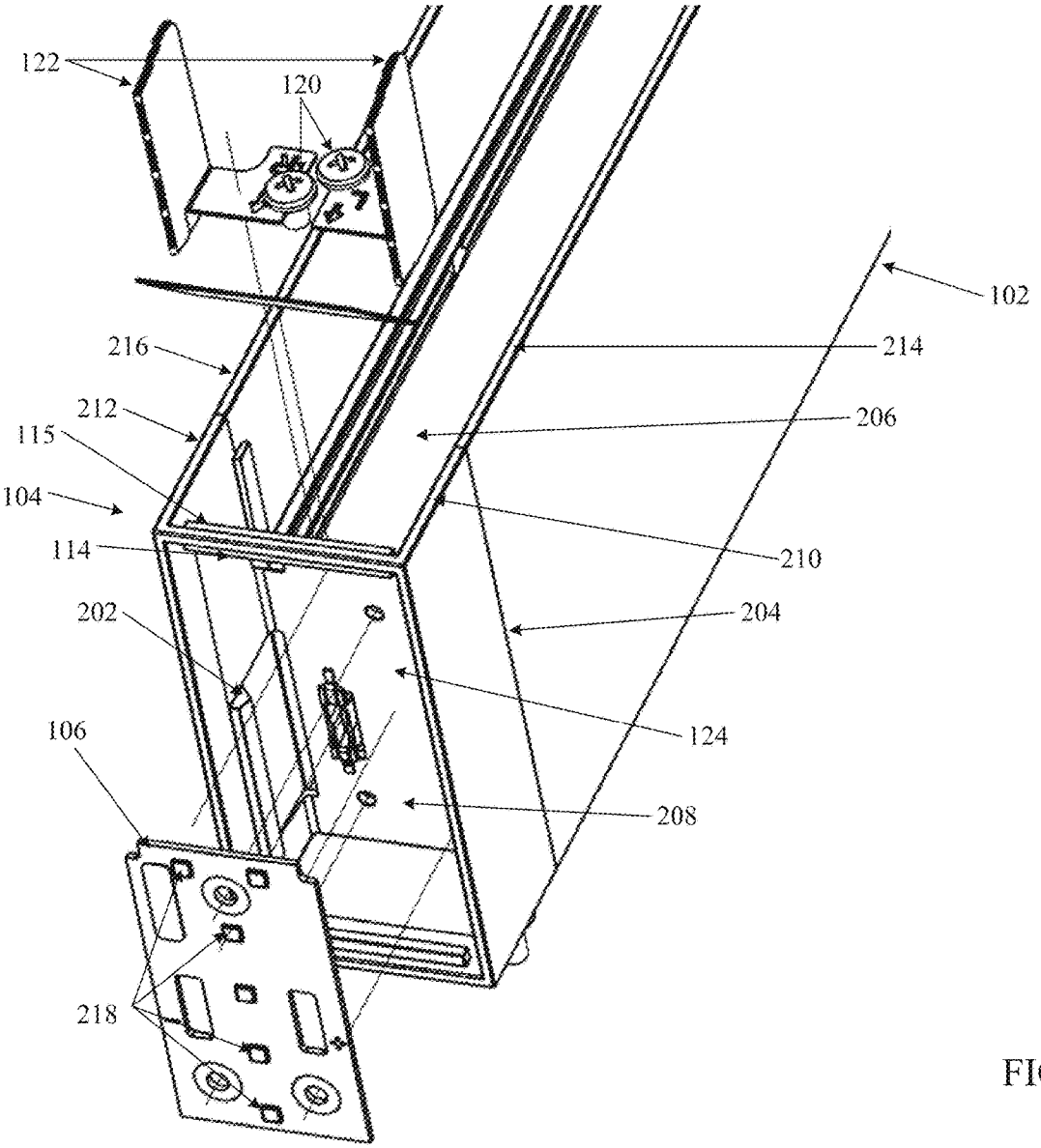
FIG. 2 is a bottom-left perspective view of a portion of an illuminated end cap, according to some aspects of the present disclosure.

FIG. 2 is a bottom-left exploded perspective view of a portion of an illuminated end cap, according to some aspects of the present disclosure. In this example, an end cap lens and main lens are not shown. End cap 104 may be attached to main housing 102 such that a joining edge aligns at seam 204. In addition, edges 210 and 212 of end cap 104 correspond with and abut edges 214 and 216 of main housing 102 respectively, to form an optical chamber 206 (e.g., a first optical chamber) for main housing 102 LEDs 702 shown in FIG. 7. As further shown in FIG. 1A, these edges cooperate to define optical chamber 206 in which main lens 112 is positioned, such that the surface of main lens 112 from which light emanates is generally flush with edges 210, 212, 214, and 216.

End cap 104 further defines optical chamber 208 (e.g., a second optical chamber) for LEDs 218, further shown in FIG. 6A. In this way, main housing 102 and end cap 104 together define optical chambers 206 and 208 that are segregated or dedicated for directing light in different directions from lighting fixture 100, without light in optical chambers 206 and 208 substantially mixing and interfering with one another. In particular, optical chamber 208 is dedicated to isolating and transmitting light from LEDs 218 through end cap lens 110, while optical chamber 206 is dedicated to isolating and transmitting light from LEDs 702 through main lens 112. In various embodiments, and as shown in and described with respect to FIGS. 5A and 5B, a wall such as wall 124 may be any portion of end cap 104 that separates optical chambers 206 and 208 to provide for different chambers for emitting light, in different directions from lighting fixture 100 (e.g., in different generally orthogonally directions such as from a bottom of a fixture and a side or end of a fixture).

As further illustrated by FIG. 2, lens engagement feature 202 is positioned in end cap 104 and is configured to interact with end cap lens 110 to attach end cap lens 110 mechanically to end cap 104. Another lens engagement feature is positioned on the opposing side of end cap 104, as shown in FIG. 5C. An edge of end cap reflector 114, and an edge of main housing reflector 115, are also visible in FIG. 2 in their installed positions on either side of wall 124 of end cap 104. Light leakage blockers 122, and their associated fasteners 120, are also shown in greater detail in FIGS. 2, 4A, and 8. Light leakage blockers 122 may be reflective or absorptive, to prevent the transmission of visible light between optical chamber 206 of main housing 102 and optical chamber 208 of end cap 104. Light leakage blockers 122 may therefore assist in providing matched or similar illuminance between the main lens and the end cap faces, and/or to provide uniformity in illumination across an end plane of a fixture (e.g., across a plane of end cap lens 110). Light leakage blockers 122 may otherwise help separate optical chambers 206 and 208 from each other so that whatever desired light is generated in those optical chambers 206 and 208 does not interfere with one another. Fasteners 120 may comprise screws, as shown in FIG. 2.

In addition, as discussed further below with respect to FIGS. 5A through 5D and 7 through 9, light leakage blockers 122 and fasteners 120 may also serve to help position and fasten end cap 104 to main housing 102. In various embodiments, end cap 104 may be attached to main housing 102 by a mechanical interaction and/or by an interference fit, such as through use of one or more latches, grooves, or alternative fasteners. In various embodiments, end cap 104 may additionally or alternatively be welded or otherwise joined to main housing 102. As further discussed herein, end cap 104 may be secured to main housing 102 using a combination of mechanically interlocking features, fasteners, and/or welding. In various embodiments, an end cap may be formed integrally with a main housing at the same time, such that the two portions of a lighting fixture need not be joined. In the example of FIG. 2, end cap 104 is attached such that end cap 104 is tightly coupled to main housing 102, with no visible gaps between the edges of end cap 104 and the main housing 102.

In various embodiments, and as shown in the exploded view of FIG. 1C, end cap 104 may be manufactured separately from main housing 102 and attached to main housing 102 during later assembly of a lighting fixture. As such, a portion of end cap 104 may serve as an attachment interface configured for attaching end cap 104 to an attachment interface of main housing 102 as described herein. The attachment interfaces of end cap 104 and main housing 102 may take various forms in various embodiments. For example, as discussed further below, tab 406 (shown in FIGS. 4B, 5B, and 5D-5H) may extend from the main body of end cap 104 over a portion of main housing 102 of lighting fixture 100, and may be used to help secure and or fit end cap 104 to main housing 102 by creating an interference fit and/or by being welded to main housing 102. As another example of an attachment interface, light blocking features 520 (shown in FIGS. 5B and 5D-5H) may fit around attachment interface features 521 (shown in FIGS. 7 and 8) on which LEDs 702 of main housing 102 are mounted, to secure end cap 104 to main housing 102. Another example of an attachment interface between end cap 104 and main housing 102 includes engagement features 202 and openings 502 of end cap 104 (shown in FIGS. 2, 5A-5D) that receive and/or engage with light leakage blockers 122 (shown in FIGS. 1C, 2, 4A, 8, and 9) that are attached to main housing 102, to attach end cap 104 to main housing 102. In yet another example of an attachment interface, end cap 104 may include post 516 (shown in FIGS. 5B, 5D-5F, and 5H) that fits into opening 706 (shown in FIGS. 7 and 8) to create an interference fit between end cap 104 and main housing 102, or otherwise attach end cap 104 to main housing 102. In another example of an attachment interface, fasteners 108 (shown in FIGS. 1C, 4A, 4B, and 8) that pass through LED board 106 and the screw holes within end cap 104, may also be used to attach end cap 104 to main housing 102 via openings 704 of main housing 102 (shown in FIG. 7).

Figure 3:
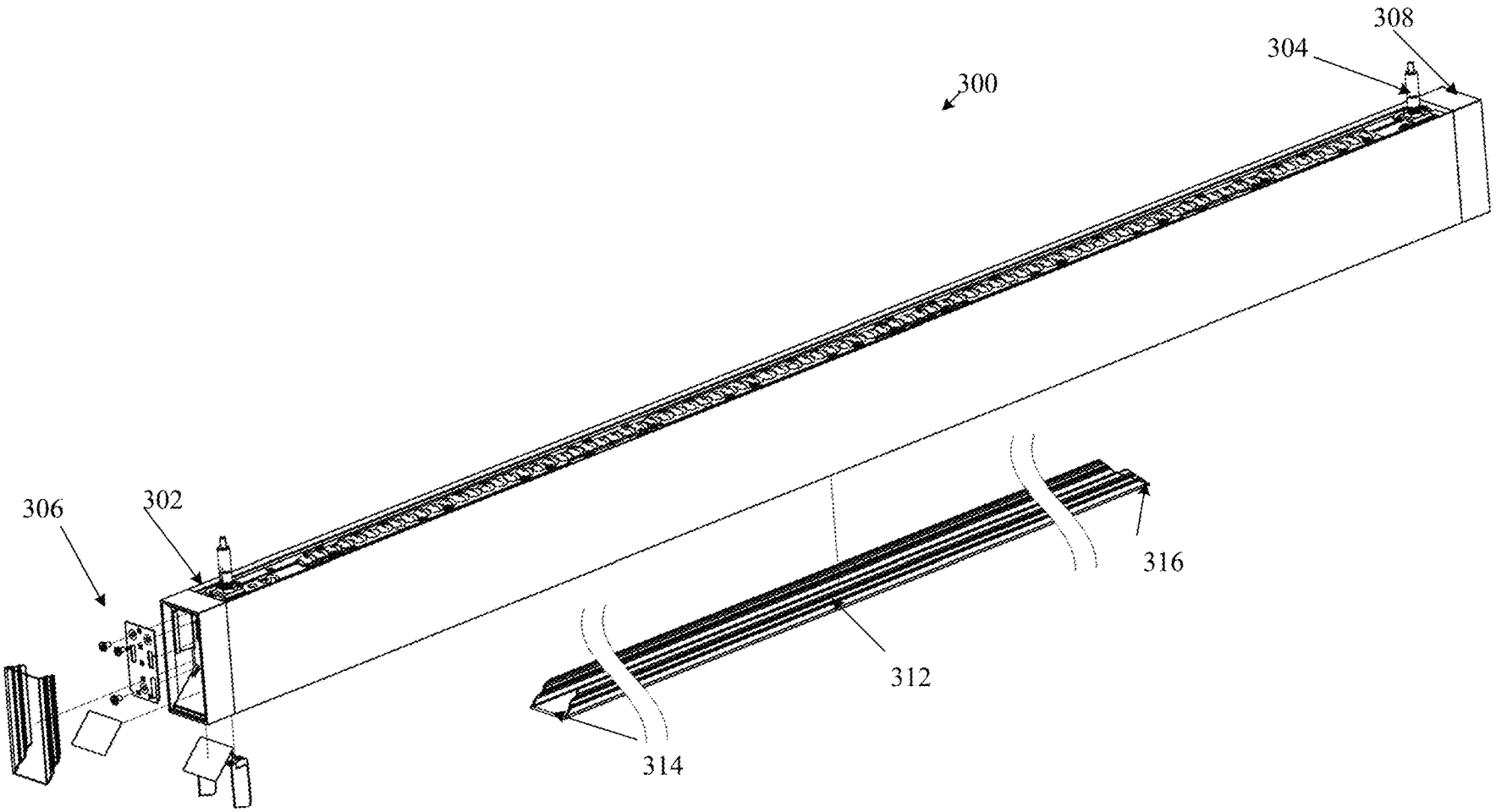
FIG. 3 is a top-left perspective view of a lighting fixture with two illuminated end caps, according to some aspects of the present disclosure.

FIG. 3 is a perspective view of a portion of a lighting fixture with an illuminated end cap on both ends, according to some aspects of the present disclosure. The lighting fixture 300 includes first end 302 and second end 304. First end 302 may have first end cap 306 (shown exploded), and second end 304 may have second end cap 308 (shown fully assembled). As described herein, in some embodiments, a fixture may have only a single illuminated end cap similar to or the same as the end caps described herein in detail, such that only one end of a fixture emits light in a different direction than a main lens of the fixture. Lighting fixture 300 may also include a lens 312. Lens 312 may have a first tapered edge 314 oriented toward first end 302 and a second tapered edge 316 oriented toward second end 304. Tapered edges 314 and 316 assist in fitting into the shape of end caps 306 and 308, where those end caps are shaped similarly to or the same as end cap 104, as further described herein. In addition, in order to better fit lens 312 into FIG. 3, lens 312 is scaled down. While lens 312 is scaled down for ease of demonstration in FIG. 3, lens 312 in actual size fits within and corresponds to an entire length of a main housing of lighting fixture 300.

Figure 4A:
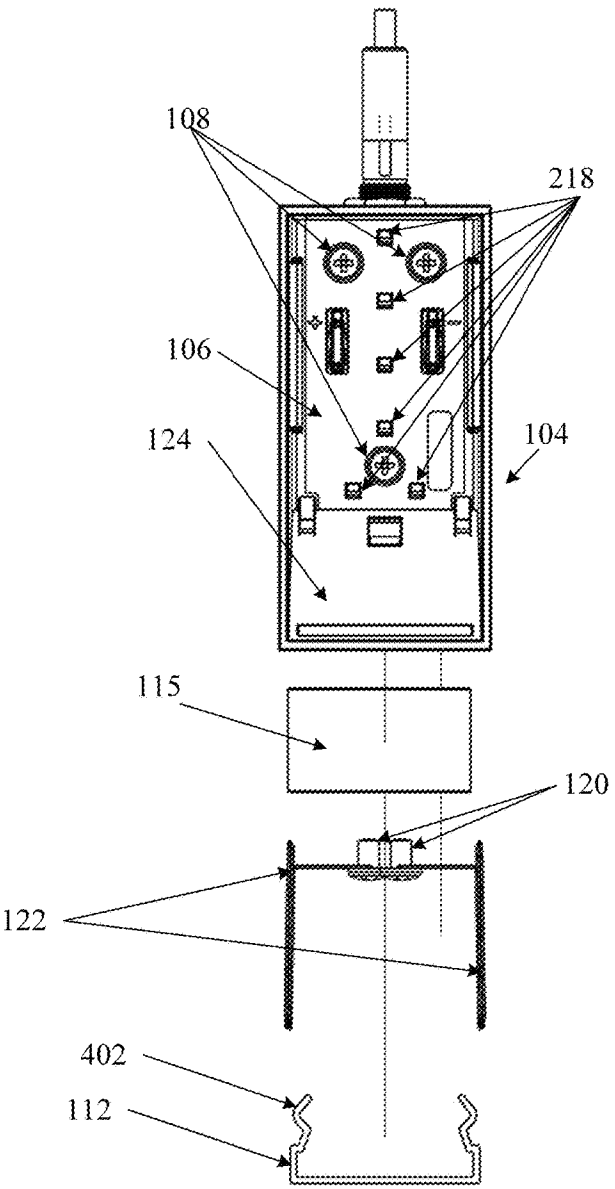
FIG. 4A is an elevated, left side exploded view of a lighting fixture showing the front of an illuminated end cap, according to some aspects of the present disclosure.
Figure 5B:
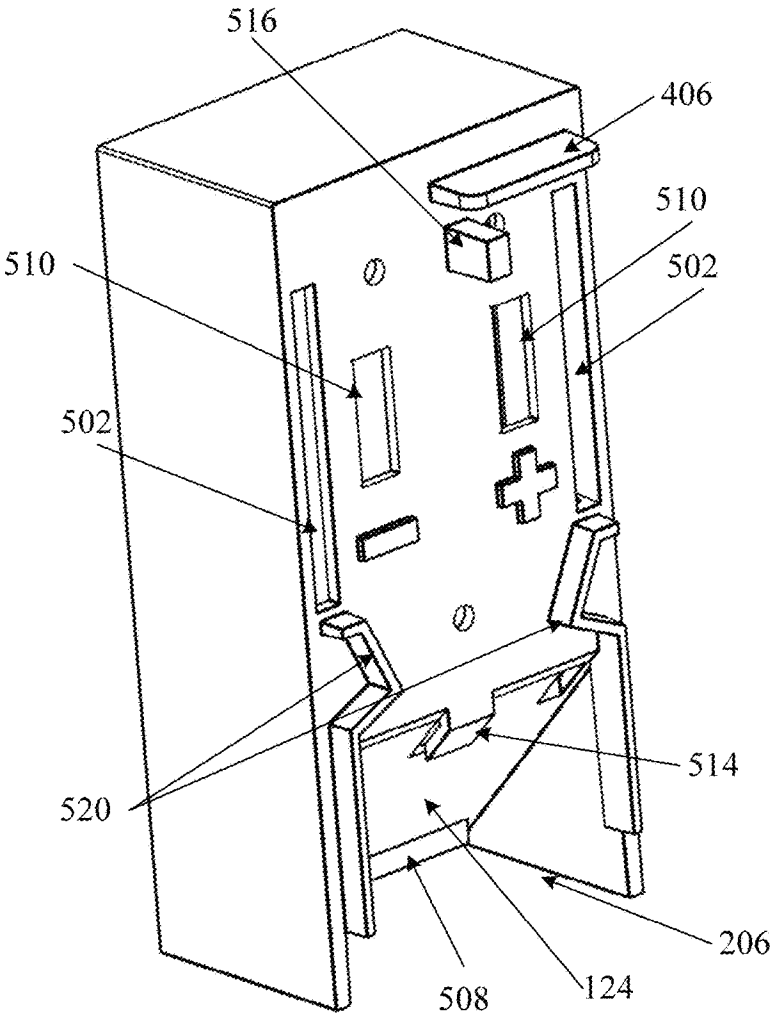
FIG. 5B is a top-left perspective view of the rear of the end cap of FIG. 5A, according to some aspects of the present disclosure.
Figure 5A:
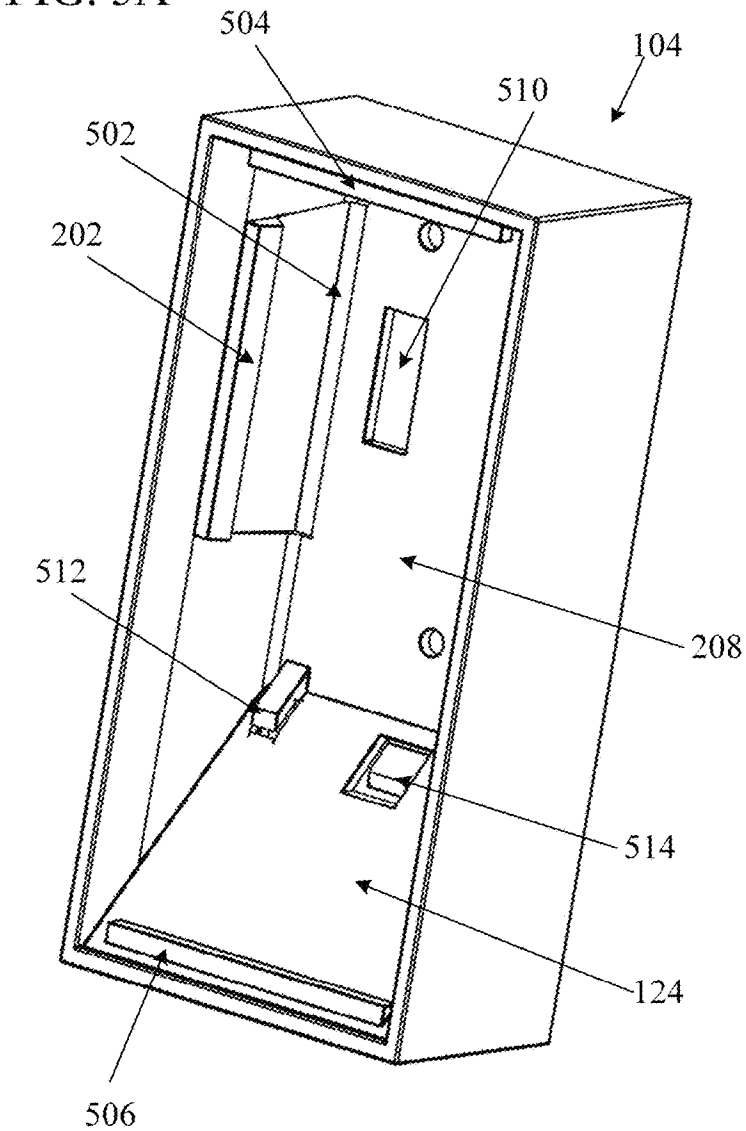
FIG. 5A is top-right perspective view of the front of an end cap, according to some aspects of the present disclosure.
Figure 5D:
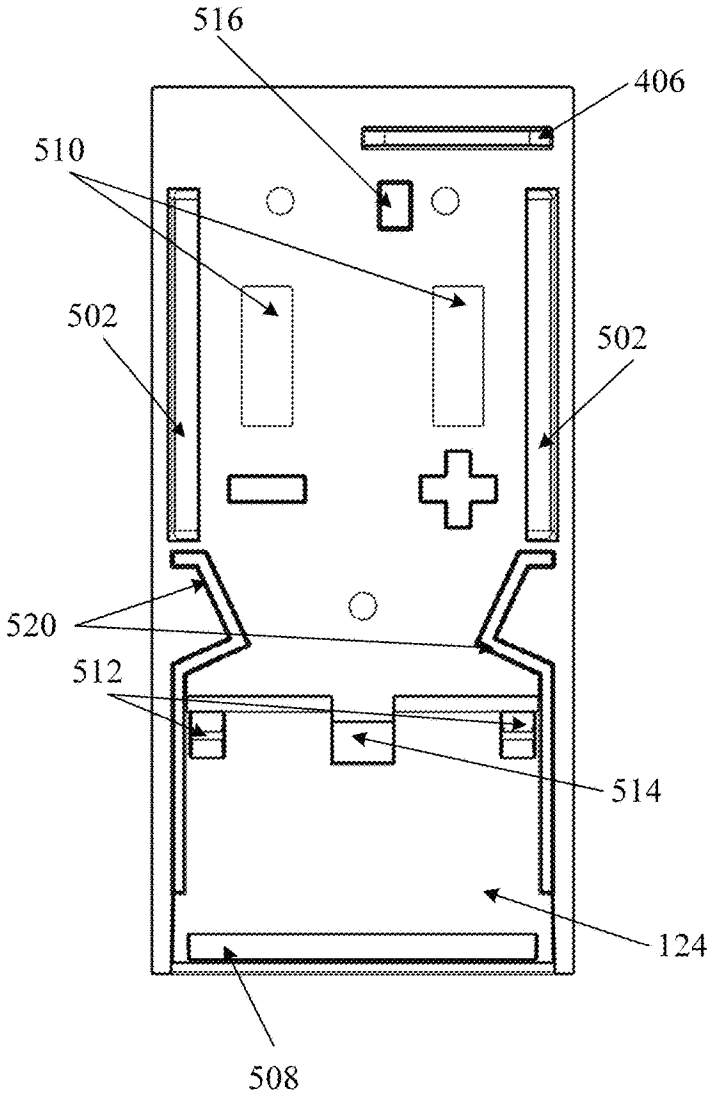
FIG. 5D is a rear elevational view of the end cap of FIG. 5A, according to some aspects of the present disclosure.
Figure 5C:
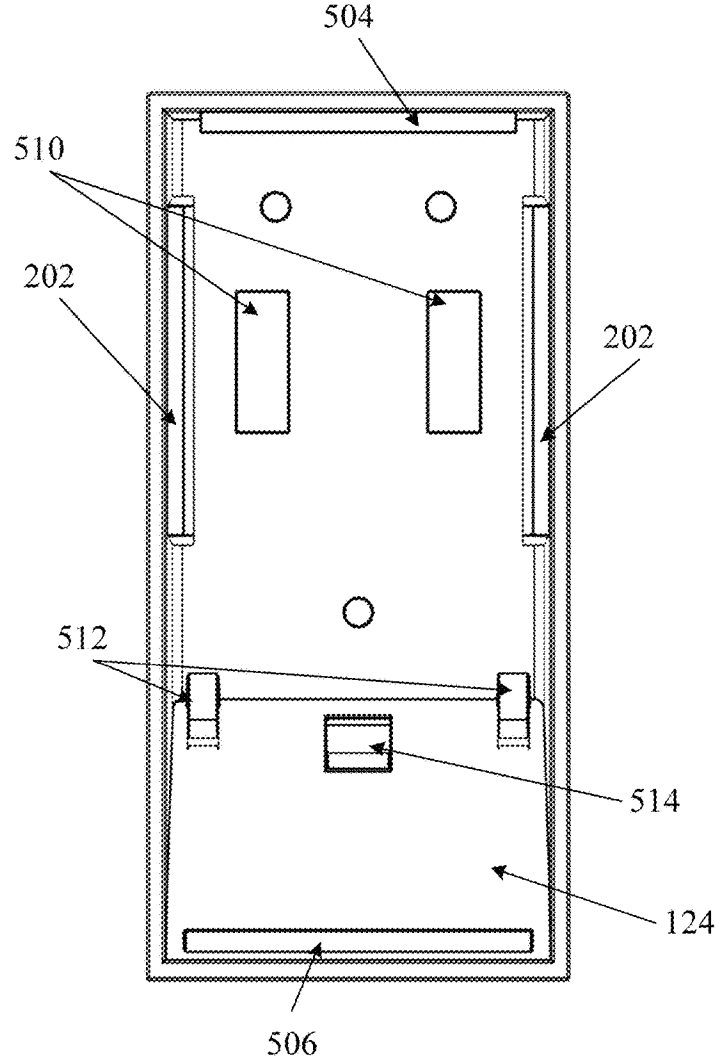
FIG. 5C is a front elevational view of the end cap of FIG. 5A, according to some aspects of the present disclosure.
Figure 8:
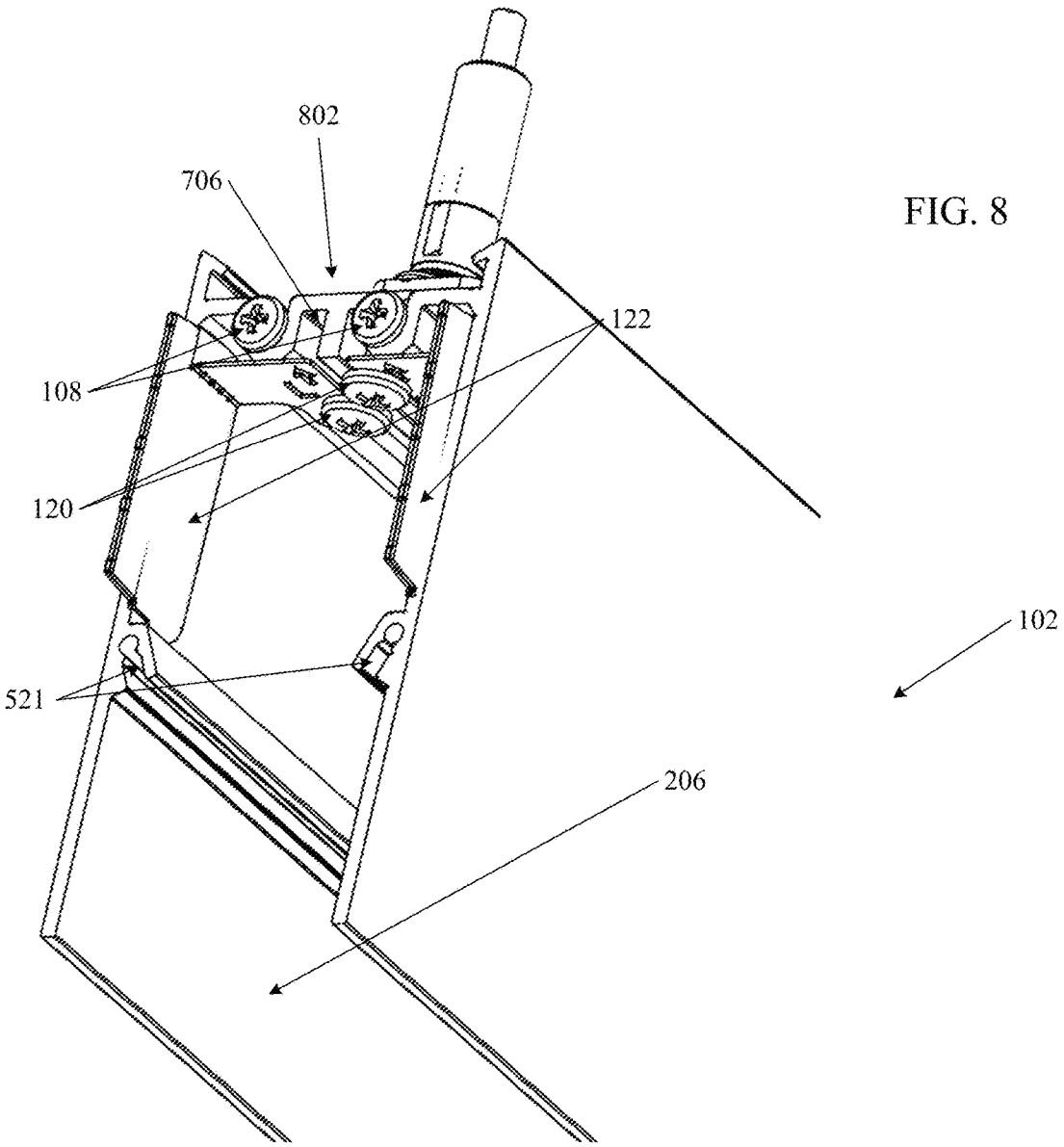
FIG. 8 shows another bottom-left perspective view of a main housing of a lighting fixture having light leakage blockers, according to some aspects of the present disclosure.

FIG. 4A is a left side exploded view of lighting fixture 100, according to some aspects of the present disclosure. For instance, FIG. 4A demonstrates aspects of lighting fixture 100 including end cap 104, fasteners 108, reflector 115, LED board 106, end cap LEDs 218, wall 124, light leakage blockers 122, and main lens 112. Other aspects and sub-components of end cap 104 are not shown in FIG. 4A so that an inside of end cap 104 and how LED board 106 is mounted therein may be appreciated. Light leakage blockers 122 and their associated fasteners 120, as well as how they interact to secure end cap 104 to main housing 102, are shown in FIG. 8.

FIG. 4A also depicts engagement feature 402 of main lens 112. In this example, main lens 112 may include a mechanical engagement feature 402 that may be compressed or otherwise be deformed upon insertion into main housing 102, for expansion around a corresponding engagement feature in main housing 102—to retain main lens 112 within main housing 102 through a friction fit or similar fitment. In another example, main lens 112 may latch or be integrated into a main housing via rivets, fusion of material, or any other manner of attaching a lens to a housing.

Figure 4B:
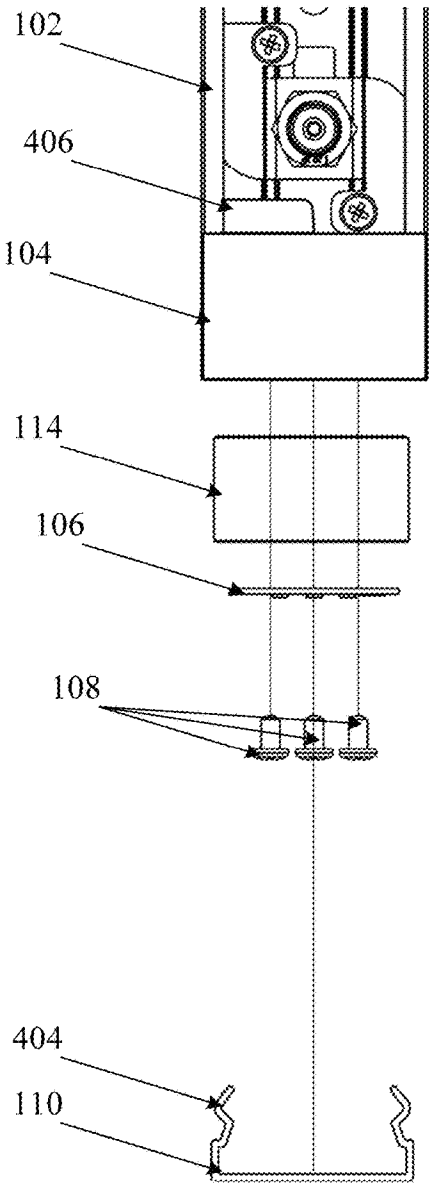
FIG. 4B is a top plan view of an illuminated end cap forming a portion of a lighting fixture, according to some aspects of the present disclosure.

FIG. 4B is a top view of end cap 104 and a portion of main housing 102 of lighting fixture 100, according to some aspects of the present disclosure. FIG. 4B further depicts LED board 106, end cap lens 110, fasteners 108, and end cap reflector 114. Similar to main lens 112 described above, end cap lens 110 may also have an engagement feature 404 that may be compressed and then expand to fit with a corresponding engagement feature 202 of end cap 104 (shown in FIGS. 2, 4B, 5A, and 5C). In this way end cap lens 110 may be affixed to and secured to end cap 104 such that an outward facing surface of end cap lens is flush with the edges of end cap 104 (e.g., as shown in FIGS. 1A, 1B, and 9) or otherwise secured in a desired position with respect to end cap 104.

End cap 104 further includes tab 406 that extends from the main body of end cap 104 over a portion of main housing 102 of lighting fixture 100. Tab 406 may be used to help secure and or fit end cap 104 to main housing 102. Tab 406 is further shown and described with respect to FIGS. 5B, 5D through 5H, and 9. For example, tab 406 may fit into a recessed portion of a top of main housing 102. Further, end cap 104 may be secured to main housing 102 by serving as a welding tab. A spot weld or other type of weld may be applied to join tab 406 of end cap 104 and a top surface of main housing 102.

FIGS. 5A through 5H show various views of end cap 104. In particular, end cap 104 includes engagement features 202, 512, and 514; openings 502 and 510; light blocking features 504, 506, 508, and 520; tab 406; and post 516. Engagement features 202 are configured to engage and secure end cap lens 110 as described herein. Engagement features 512 are specifically configured to secure end cap reflector 114 in end cap 104 along wall 124. End cap reflector 114 may further be secured in end cap 104 by light blocking feature 506. Light blocking feature 506 further serves to substantially prevent unwanted light from leaking around an end of end cap lens 110. Engagement feature 514 similarly is configured to retain main housing reflector 115 against wall 124. Main housing reflector 115 may further be retained in end cap 104 by light blocking feature 508, that also serves to substantially prevent unwanted light from leaking around an end of main housing lens 112. Similarly, light blocking feature 504 is configured to substantially block light from leading around an end of end cap lens 110.

In various embodiments, wall 124 may be considered to include a portion of end cap 104 that has openings 502 and 510 therein (where LED board 106 is mounted). Because that portion of end cap 104 also serves to block light from moving between and forms optical chambers 208 and 206, wall 124 includes both the portions that end cap reflector 114 and main housing reflector 115 are mounted on, as well as a portion upon which LED board 106 is mounted.

End cap 104 further includes openings 502 that receive light leakage blockers 122, to prevent light from moving between optical chambers 206 and 208, as well as for securing end cap 104 to main housing 102. End cap 104 further includes light blocking features 520 that further block light from optical chamber 206 from getting near openings 502, further segregating optical chambers 206 and 208.

Figure 7:
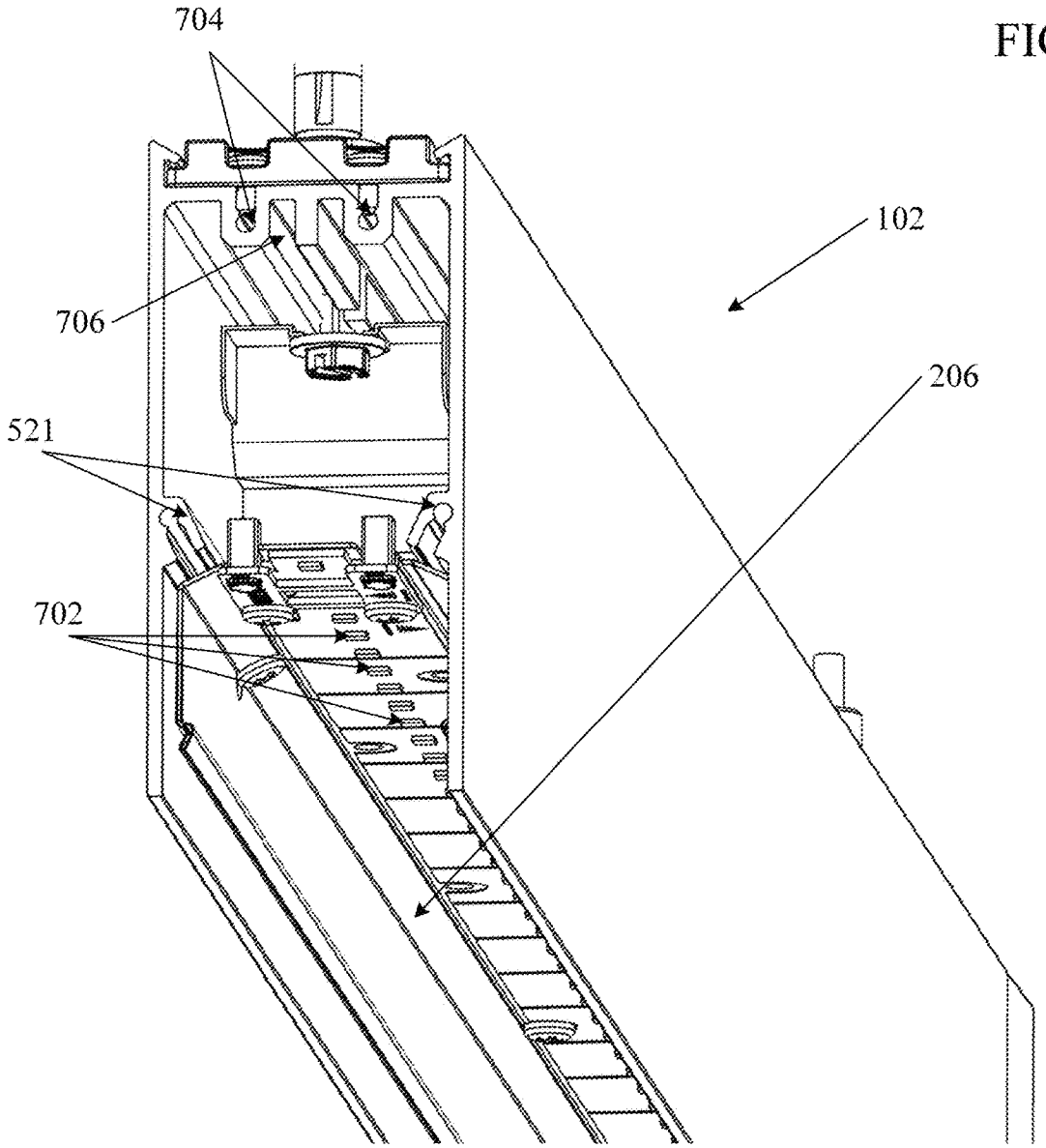
FIG. 7 shows a bottom-left perspective view of a main housing of a lighting fixture, according to some aspects of the present disclosure.

End cap 104 further includes post 516 and tab 406 that may engage with features of main housing as discussed further herein with respect to FIGS. 7 and 8. The post 516 and tab 406 therefore may be used to properly position end cap 104 with respect to main housing 102, and to attach end cap 104 to main housing 102.

Openings 510 provide for terminals 602 to pass through wall 124 such that LED board 106 may be electrically connected to circuitry within main housing 102. In particular, FIGS. 6A and 6B show LED board 106 that includes LEDs 218, terminals 602, and circuitry for connecting terminals 602 to LEDs 218 (not shown). FIG. 6A shows a front perspective view of LED board 106, while FIG. 6B shows a rear perspective view of LED board 106. LED board 106 in FIG. 6B further shows example wire 604 that may be connected to one of terminals 602. While only a single wire 604 is shown in FIG. 6B, it will be appreciated that a second wire may also be connected to the other of terminals 602, and that multiple wires may be connected to LED board 106 via terminals 602 (e.g., to power LEDs 218).

FIG. 7 shows a bottom-left perspective view of main housing 102. Specifically, FIG. 7 shows LEDs 702 that may emit light into optical chamber 206 of main housing 102, which is then transmitted out of the bottom of lighting fixture 100 through main lens 112 (as shown in FIG. 1A). Further, FIG. 7 shows openings 704 that may receive fasteners 108 to connect LED board 106 to end cap 104 and to connect both LED board 106 and end cap 104 to main housing 102. Opening 706 may receive post 516 to interference fit end cap 104 to main housing 102 and/or assist in properly aligning end cap 104 and main housing 102.

FIG. 8 shows a bottom-left perspective view of main housing 102 of lighting fixture 100 with light leakage blockers 122. In particular, FIG. 8 shows how light leakage blockers 122 may be affixed to main housing 102 using fasteners 120 in openings of the inside of main housing (e.g., opening 706). Portions of light leakage blockers 122 then extend away from main housing to insert into openings 502 of end cap 104 to block light and to assist in securing end cap 104 to main housing 102 and to ensure that end cap 104 and main housing 102 are properly aligned with one another.

FIG. 8 also shows recess 802 in the top of housing 102 that may receive tab 406 of end cap 104. As such, the top of main housing 102 may be secured between tab 406 and post 516 of end cap 104.

FIG. 9 shows a cross-sectional perspective view of end cap 104 of lighting fixture 100. In particular, FIG. 9 demonstrates how the various components of lighting fixture 100 fit together. For example, the assembly creates segregated optical chamber 206 and 208 on either side of wall 124 so that the light that illuminates end cap lens 110 generally does not mix with or interfere with the light that illuminates main lens 112

While this disclosure has described certain embodiments, it will be understood that the claims are not intended to be limited to these embodiments except as explicitly recited in the claims. On the contrary, the instant disclosure is intended to cover alternatives, modifications and equivalents, which may be included within the spirit and scope of the disclosure. Furthermore, in the detailed description of the present disclosure, numerous specific details are set forth in order to provide a thorough understanding of the disclosed embodiments. However, it will be obvious to one of ordinary skill in the art that apparatuses, systems, and methods consistent with this disclosure may be practiced without these specific details. In other instances, well known methods, procedures, components, and circuits have not been described in detail as not to unnecessarily obscure various aspects of the present disclosure.

To the extent that any methods and/or processes are set forth or will be set forth herein as comprising one or more "steps," such steps are not required to be performed in any particular order except as mandated by logic or as specifically set forth in the claims.

What is claimed is:

1. A lighting fixture comprising:

a housing with a first end and a second end;

a first plurality of light emitting diodes (LEDs) configured to illuminate a main lens of the housing between the first end and the second end;

an end cap disposed at the first end, the end cap comprising:

an end cap lens, and a second plurality of LEDs configured to illuminate the end cap lens; and a wall configured to substantially prevent light emitted from the second plurality of LEDs from being emitted through the main lens of the housing.

2. The lighting fixture of claim 1, further comprising:

a first reflector positioned on a first side of the wall, the first reflector configured to reflect light from the first plurality of LEDs through the main lens; and a second reflector positioned on a second side of the wall, the second reflector configured to reflect light from the second plurality of LEDs through the end cap lens.

3. The lighting fixture of claim 1, further comprising one or more light leakage blockers disposed on or along the wall, the one or more light leakage blockers configured to substantially prevent transmission of light:

emitted from the second plurality of LEDs from being emitted through the main lens; and emitted from the first plurality of LEDs from being emitted through the end cap lens.

4. The lighting fixture of claim 1, in which the main lens is configured to transmit light in a first direction, and in which the end cap lens is configured to transmit light in a second direction generally orthogonal to the first direction.

5. The lighting fixture of claim 1, in which the end cap further comprises one or more lens engagement features configured to attach the end cap lens to the end cap.

6. The lighting fixture of claim 5, in which:

said one or more lens engagement features comprise at least one of a cutout, a groove, and an edge that extends into an interior chamber of the end cap; and the end cap lens includes a corresponding mechanical feature that interacts with the one or more lens engagement features.

7. A lighting fixture system comprising:

a housing with a first end and a second end;

a first light source configured to illuminate a main lens of the housing between the first end and the second end;

an end cap lens at the first end;

a second light source configured to illuminate the end cap lens;

a wall within the housing configured to substantially prevent light emitted from the second light source from being emitted through the main lens; and at least one control circuit configurable to provide at least one control signal to the first light source and to the second light source.

8. The lighting fixture system of claim 7, in which the lighting fixture further comprises:

a first reflector positioned on a first side of the first light source to reflect light from the first light source through the main lens; and a second reflector positioned to reflect light from the second light source through the end cap lens.

9. The lighting fixture system of claim 7, in which the lighting fixture further comprises one or more light leakage blockers disposed on or along the wall, the one or more light leakage blockers configured to substantially prevent transmission of light:

emitted from the second light source from being emitted through the main lens; and emitted from the first light source from being emitted through the end cap lens.

10. The lighting fixture system of claim 7, in which the first light source is configured to emit light in a first direction, and in which the second light source is configured to emit light in a second direction, generally orthogonal to the first direction.

11. The lighting fixture system of claim 10, in which:

a first portion of the wall is oriented in a first plane that is generally parallel to the first direction;

the second light source is mounted on the first portion of the wall; and a second portion of the wall connected to the first portion of the wall is oriented at an angle with respect to the first direction, the second direction, and the first plane.

12. The lighting fixture system of claim 7, in which:

a first reflector positioned on a first side of the second portion of the wall is configured to reflect light emitted by the second light source toward the end cap lens; and a second reflector positioned on a second side of the second portion of the wall is configured to reflect light emitted by the first light source toward the main lens.

13. The lighting fixture system of claim 7, in which the at least one control circuit comprises one of:

a single control circuit configured to control both of the first light source and the second light source; and a plurality of control circuits in which the first light source is controlled by at least one first control circuit and the second light source is controlled by at least one second control circuit different form the first control circuit.

14. A lighting fixture comprising:

a housing;

a wall within the housing, in which the wall and the housing together form a first optical chamber and a second optical chamber separated by the wall;

a first light source in the first optical chamber configured to illuminate a first lens attached to the housing; and a second light source in the second optical chamber configured to illuminate a second lens attached to the housing, in which the first lens is oriented generally orthogonal to the second lens, and in which the wall is configured to substantially block light emitted from the second light source from illuminating the first optical chamber.

15. The lighting fixture of claim 14, in which the wall is configured to substantially block light emitted from the first light source from illuminating the second optical chamber.

16. The lighting fixture of claim 14, in which:

the first lens comprises a first light emitting surface, the second lens comprises a second light emitting surface, and the first light emitting surface is oriented generally orthogonal to the second light emitting surface.

17. The lighting fixture of claim 16, in which the wall is oriented at an angle with respect to both of the first light emitting surface and the second light emitting surface.

18. The lighting fixture of claim 14, in which the first light source and the second light source are controlled by a single control circuit.

19. The lighting fixture of claim 14, in which the first light source is controlled by a first control circuit and the second light source is controlled by a second control circuit, separate from the first control circuit.

* * * * *